US006745772B1

(12) United States Patent
McLeod

(10) Patent No.: US 6,745,772 B1
(45) Date of Patent: Jun. 8, 2004

(54) OXYGEN MASK SUPPORT SYSTEM

(76) Inventor: Donna J. McLeod, 6046 Elerbee Rd., Wesley Chapel, FL (US) 33544

( * ) Notice: Subject to any disclaimer, the term of this patent is extended or adjusted under 35 U.S.C. 154(b) by 121 days.

(21) Appl. No.: 09/768,596

(22) Filed: Jan. 25, 2001

(51) Int. Cl.[7] ..... A62B 18/02
(52) U.S. Cl. ..... 128/206.21; 128/202.18
(58) Field of Search ..... 128/202.13, 202.16, 128/202.18, 205.26, 201.22, 201.24, 201.29, 207.11, 206.21, DIG. 24, 206.13, 207.17, 202.19, 206.26; 5/636, 637, 640, 638, 639

(56) References Cited

U.S. PATENT DOCUMENTS 3,923,054 A * 12/1975 Bauer, Jr. ..... 128/202.18
4,679,263 A * 7/1987 Honer ..... 297/393
4,738,488 A * 4/1988 Camelio ..... 297/383
5,103,516 A * 4/1992 Stevens ..... 5/640
5,216,770 A * 6/1993 Holt ..... 128/202.18
5,231,720 A * 8/1993 Benoff ..... 5/644
5,233,705 A * 8/1993 Coleman et al. ..... 4/496
5,313,678 A * 5/1994 Redewill ..... 297/393
5,488,944 A * 2/1996 Kennedy ..... 128/202.18
5,522,105 A * 6/1996 Fujiwara et al. ..... 128/202.18
5,546,620 A * 8/1996 Matthews ..... 5/655
5,586,351 A * 12/1996 Ive ..... 5/655
5,707,709 A * 1/1998 Blake ..... 112/413
5,813,065 A * 9/1998 Tinhorn ..... 5/636
5,988,173 A * 11/1999 Scruggs ..... 128/870
6,038,720 A * 3/2000 Matthews et al. ..... 5/636
6,050,265 A * 4/2000 Richardson ..... 128/845
6,266,832 B1 * 7/2001 Ezell ..... 297/219.12
6,321,403 B1 * 11/2001 Matthews ..... 5/637
6,427,272 B1 * 8/2002 Yacoub ..... 5/638

* cited by examiner

*Primary Examiner*—Weilun Lo
*Assistant Examiner*—Teena Mitchell

(57) ABSTRACT

A pad has an inverted U-shaped upper edge and a linear lower edge. A large pillow in an inverted U-shaped configuration is coupled to the pad adjacent to the periphery. Connectors are coupled to the pad and large pillow. Each connector has a first end with a fastener adjacent to the coupling point between the connector and the pad and a second end with a co-acting fastener whereby the connectors may form strap holding loops.

4 Claims, 3 Drawing Sheets

OXYGEN MASK SUPPORT SYSTEM

BACKGROUND OF THE INVENTION

1. Field of the Invention

The present invention relates to an oxygen mask support system and more particularly pertains to increasing the comfort to a patient requiring the use of an oxygen mask.

2. Description of the Prior Art

The use of oxygen systems of known designs and configurations is known in the prior art. More specifically, oxygen systems of known designs and configurations previously devised and utilized for the purpose of increasing patient comfort through known designs and configurations are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,400,782 to Davenport discloses a carbon dioxide gas sampling mask having a beveled sampling tube extending into the mask. U.S. Pat. No. 5,038,776 to Harrison discloses a universal head harness. U.S. Pat. No. 5,181,507 to Michel discloses an air purifying respirator suspension device. Lastly, U.S. Pat. No. 5,575,009 to Ryvin relates to a cold weather face mask and hood.

While these devices fulfill their respective, particular objectives and requirements, the aforementioned patents do not describe an oxygen mask support system that allows increasing the comfort of oxygen to a patient.

In this respect, the oxygen mask support system according to the present invention substantially departs from the conventional concepts and designs of the prior art, and in doing so provides an apparatus primarily developed for the purpose of increasing the comfort of oxygen supply to a patient.

Therefore, it can be appreciated that there exists a continuing need for a new and improved oxygen mask support system which can be used for increasing the comfort of oxygen supply tubes to a patient. In this regard, the present invention substantially fulfills this need.

SUMMARY OF THE INVENTION

In view of the foregoing disadvantages inherent in the known types of oxygen systems of known designs and configurations now present in the prior art, the present invention provides an improved oxygen mask support system. As such, the general purpose of the present invention, which will be described subsequently in greater detail, is to provide a new and improved oxygen mask support system and method which has all the advantages of the prior art and none of the disadvantages.

To attain this, the present invention essentially comprises a pad. The pad is adapted to be positioned behind the head of a patient. The pad has an inverted U-shaped upper edge and a horizontal linear lower edge. The pad is fabricated of an inner layer and an outer layer of flexible fabric. A plurality of spaced oval small pillows are provided between the inner and outer layers. The layers of fabric are attached together between the small pillows. The pillows extend vertically between the upper edge and the lower edge with the long axes of the ovals being in the plane of the layers. A large pillow is next provided. The large pillow is in an inverted U-shaped configuration which corresponds to the upper edge of the pad. The large pillow fits behind the head and ears of the patient protecting the ears of the patient from the straps of an oxygen mask which would otherwise rub against the patient's ears. The large pillow has an interior large oval of foam and an exterior fabric layer around the large oval. The exterior fabric layer is permanently coupled to the pad on the interior layer adjacent to the periphery of the pad along the majority of their extents but uncoupled adjacent to the lower extents of the large oval. The long axis of the large oval is perpendicular to the long axes of the small ovals. An upper pair of connectors is provided. The connectors are coupled to the exterior layer and aligned with the large pillow at a location above the horizontal mid-point of the large pillow. A lower pair of connectors is also provided. The lower connectors are coupled to the exterior layer aligned with the large pillow at a location below the horizontal mid-point of the large pillow. Each of the connectors has a first end. A snap is provided at the first end adjacent to the coupling point between the connector and the interior layer. Each of the connectors also has a second end. A co-acting snap at the second end allows the connectors to form strap holding loops which function with the straps of an oxygen mask to keep the mask from slipping off the face of a wearer during operation and use.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved oxygen mask support system which has all of the advantages of the prior art oxygen systems of known designs and configurations and none of the disadvantages.

It is another object of the present invention to provide a new and improved oxygen mask support system which may be easily and efficiently manufactured and marketed.

It is further object of the present invention to provide a new and improved oxygen mask support system which is of durable and reliable constructions.

An even further object of the present invention is to provide a new and improved oxygen mask support system which is susceptible of a low cost of manufacture with regard to both materials and labor, and which accordingly is then susceptible of low prices of sale to the consuming public, thereby making such oxygen mask support system economically available to the buying public.

Even still another object of the present invention is to provide an oxygen mask support system for increasing the comfort of oxygen to a patient.

Lastly, it is an object of the present invention to provide a new and improved oxygen mask support system comprising a pad with an inverted U-shaped upper edge and a horizontal linear lower edge. A large pillow in an inverted U-shaped configuration is coupled to the pad adjacent to the periphery. Connectors are coupled to the pad and large pillow. Each connector has a first end with a fastener adjacent to the coupling point between the connector and the pad and a second end with a co-acting fastener whereby the connectors may form strap holding loops.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
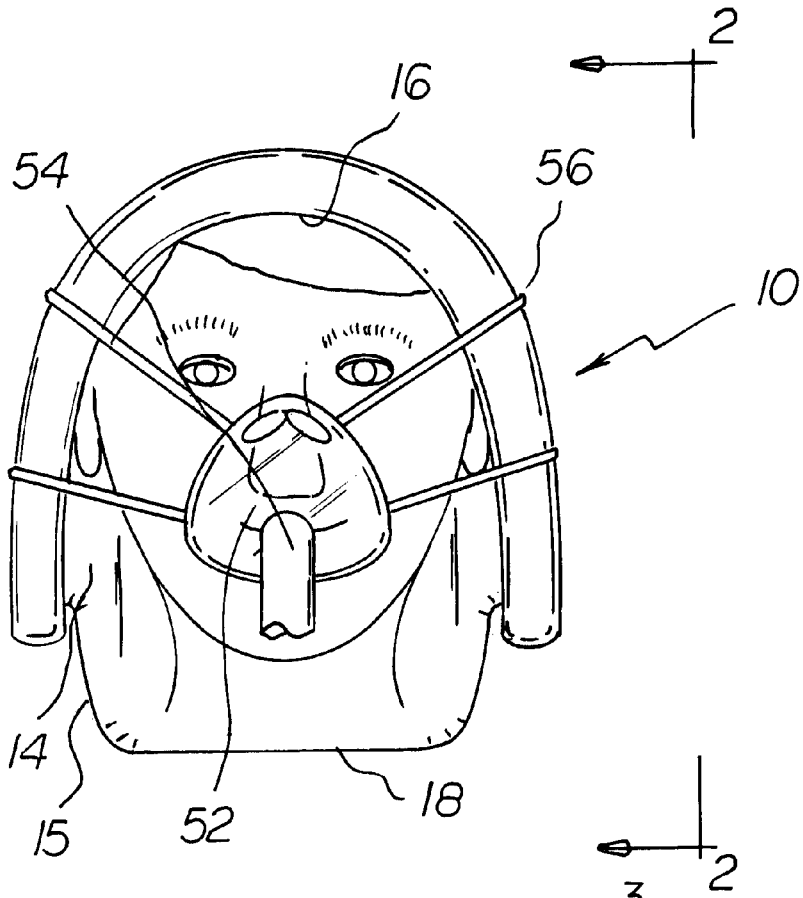
FIG. 1 is a front elevational view of the oxygen mask support system constructed in accordance with the principles of the present invention.
Figure 2:
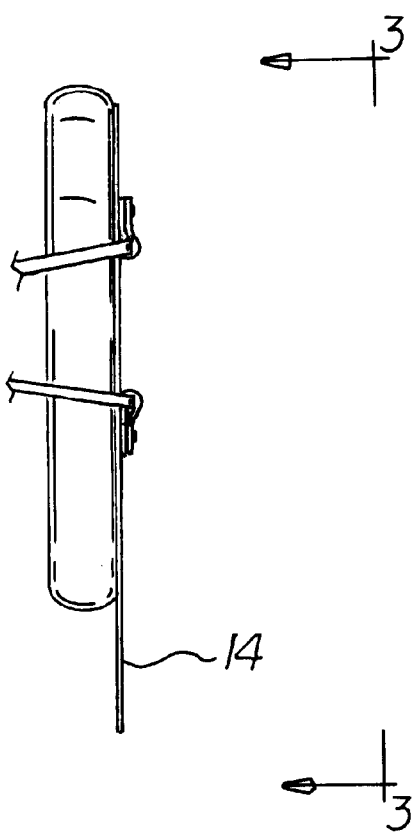
FIG. 2 is a side elevational view of the system taken along line 2—2 of FIG. 1.
Figure 3:
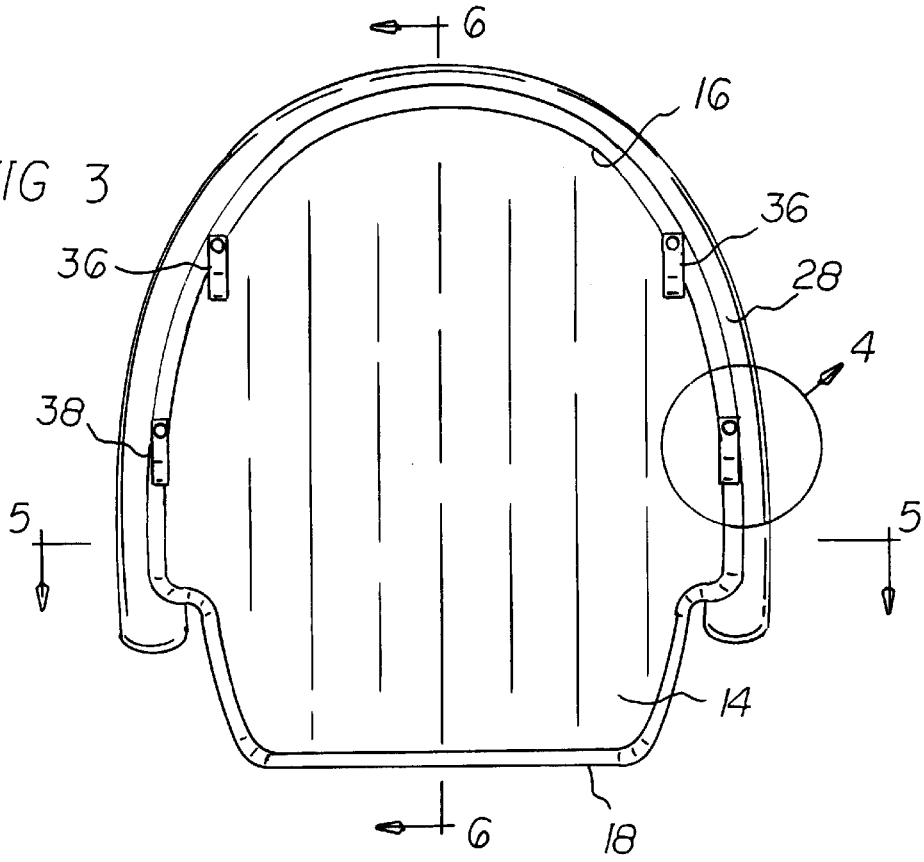
FIG. 3 is a rear elevational view taken along line 3—3 of FIG. 2.
Figure 4:
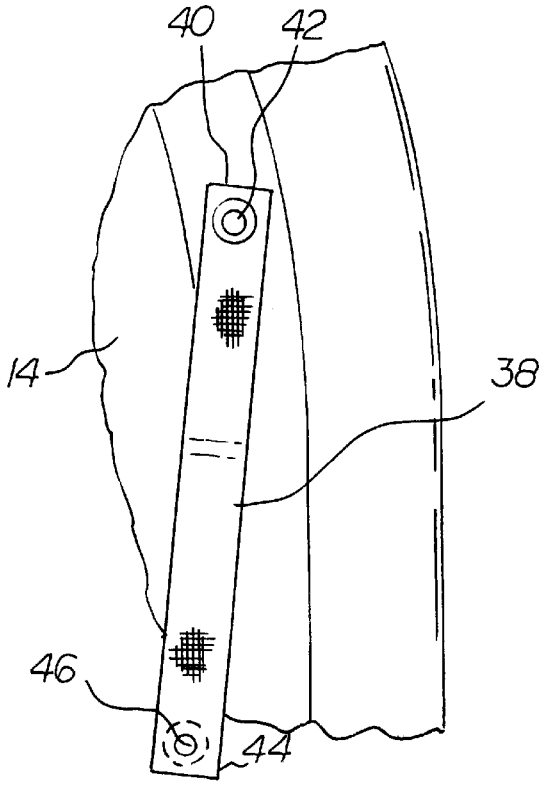
FIG. 4 is an enlarged elevational view taken a circle 4 of FIG. 3.
Figure 5:
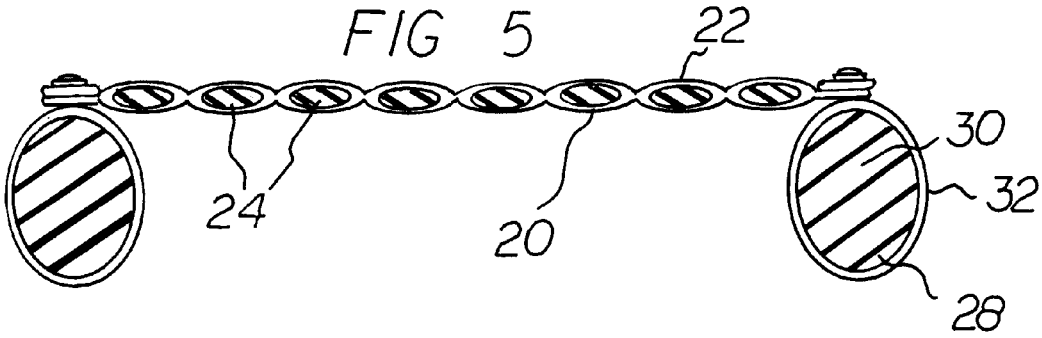
FIG. 5 is a cross-sectional view taken along line 5—5 of FIG. 3.
Figure 6:
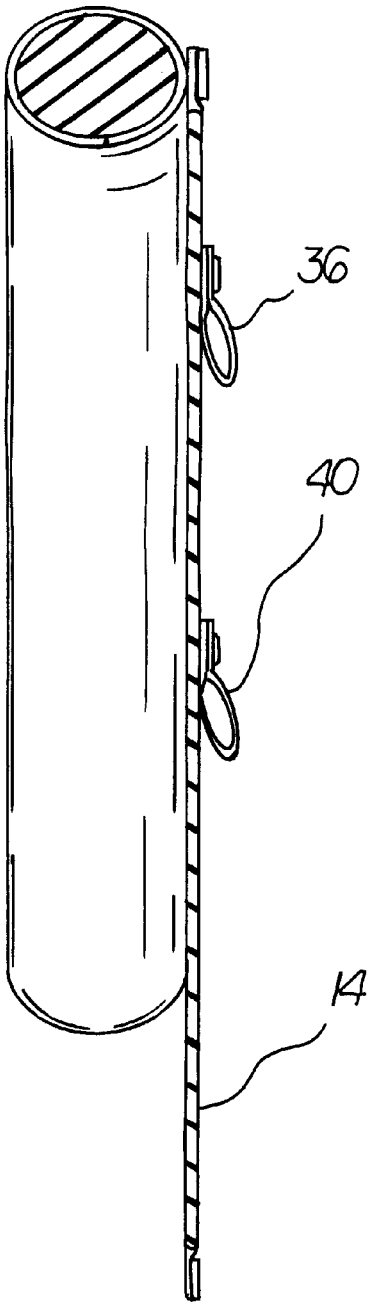
FIG. 6 is a cross-sectional view taken along line 6—6 of FIG. 3.

With reference now to the drawings, and in particular to FIG. 1 thereof, the preferred embodiment of the new and improved oxygen mask support system embodying the principles and concepts of the present invention and generally designated by the reference numeral 10 will be described.

The present invention, the oxygen mask support system 10 is comprised of a plurality of components. Such components in their broadest context include a pad, a pillow, and connectors. Such components are individually configured and correlated with respect to each other so as to attain the desired objective.

First provided is a pad 14. The pad has a periphery 15. The pad is adapted to be positioned behind the head of a patient. The pad has an inverted U-shaped upper edge 16 and a horizontal linear lower edge 18. The pad is fabricated of an inner layer 20 and an outer layer 22 of flexible fabric. A plurality of spaced oval small pillows 24 are provided between the inner and outer layers. The layers of fabric are attached together between the small pillows. The pillows extend vertically between the upper edge and the lower edge. It should be understood that the pad 14 need not be formed of an inner and outer layer. It could be fabricated otherwise as by just one layer. Its only purpose is to hold the large pillow an the head.

A large pillow 28 is next provided. The large pillow is in an inverted U-shaped configuration which corresponds to the upper edge of the pad. The large pillow has an interior large oval 30 of foam and an exterior fabric layer 32 around the large oval. The exterior fabric layer is permanently coupled to the pad on the interior layer adjacent to the periphery of the pad along a majority of their extents but uncoupled adjacent to lower extents 34 of the large oval.

An upper-pair of connecters 36 is provided. The connectors are coupled to the outer layer and aligned with the large pillow at a location above a horizontal mid-point 37 of the large pillow. A lower pair of connectors 38 is also provided. The lower connectors are coupled to the outer layer aligned with the large pillow at a location below the horizontal mid-point of the large pillow. Each of the connectors has a first end 40. A snap 42 is provided at the first end adjacent to a coupling point between the connector and the inner layer. Each of the connectors also has a second end 44. A co-acting snap 46 at the second end allows the connectors to form strap holding loops. It should be understood that the snaps could be replaced by any suitable fastener, for example, a pile-type hook and loop fastener.

The oxygen mask support system 10 of the present invention is adapted to be used in association with an oxygen mask 52, as for example an oxygen mask of the type shown in FIG. 1. Such an oxygen mask is positionable over the nose and mouth of a patient during operation and use. Such an oxygen mask normally includes downwardly extending tube 54 for the introduction of oxygen to a patient from a supply and is formed with peripheral edges coupled to upper and lower straps 56 positionable around the back of the head of a patient for support purposes. The straps are maintained out of contact with the patient's head and ears through the pad and pillow with upper and lower connectors 36, 38 as described above. In this manner the comfort of a patient during use is increased.

The system is designed to fit over the back of the user's head with the rounded portion fitting around the top of the user's head. The system is used to protect the ears on patients who have to use oxygen. The system provides cushioning to the ear, fitting just behind the ear. The oxygen masks used in the hospital have straps that go over the ears and behind the head, sometimes making the patient's ears very sore. Blood thinning medicines used by heart patients cause these irritated areas to bleed. In addition, because the oxygen masks have a tendency to slip down, patients have to repeatedly adjust the mask causing frustration. The fasteners on back of the system hold the mask in place and the patient rests more easily. The present invention is not intended to replace or modify existing oxygen masks but to render their usage more comfortable to patients.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those, skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An oxygen mask support system for increasing the comfort of oxygen supply to a patient comprising, in combination:

a pad having a periphery and an inverted U-shaped upper edge and a horizontal linear lower edge adapted to be positioned behind the head of a patient, the pad being fabricated of an inner layer and an outer layer of flexible fabric with a plurality of spaced oval small pillows there between and with the layers of fabric attached together between the small pillows, the pillows extending vertically between the inverted U-shaped upper edge and the horizontal linear lower edge of the pad;

a large pillow in an inverted U-shaped configuration corresponding to the upper edge of the pad and having an interior large oval of foam and an exterior fabric layer there around, the exterior fabric layer being permanently coupled to the pad on the interior layer adjacent to the periphery of the pad adjacent to the upper extent of the large oval but uncoupled adjacent to lower extents of the large oval;

an upper pair of connectors coupled to the outer layer aligned with the large pillow at a location above a horizontal mid-point of the large pillow and a lower pair of connectors coupled to the outer layer aligned with the large pillow at a location below the horizontal mid-point of the large pillow, each of the connectors having a first end with a snap adjacent to a coupling point between the connector and the inner layer and a second end with a co-acting snap whereby the connectors may form strap holding loops; and an oxygen mask with straps selectively received in a selected pair of loops for thereby increasing the comfort of a patient during use.

2. An oxygen mask support system comprising:

a pad having a periphery and an inverted U-shaped upper edge and a linear lower edge;

a large pillow in an inverted U-shaped configuration coupled to the pad adjacent to the periphery;

connectors coupled to the pad and large pillow, each of the connectors having a first end with a fastener adjacent to a coupling point between the connector and the pad and a second end with a co-acting fastener whereby the connectors may form strap holding loops; and an oxygen mask with straps selectively receive in a selected pair of loops for thereby increasing the comfort of a patient during use.

3. The system as set forth in claim 2 wherein the connectors include two pair of connectors including an upper pair of connectors coupled to the large pillow at a location above a horizontal mid-point of the pillow and a lower pair of connectors coupled to the pillow at a location below the horizontal mid-point of the large pillow.

4. The system as set forth in claim 2 wherein the fasteners are snaps.

* * * * *